US005896679A

United States Patent [19]

Baldwin

[11] Patent Number: 5,896,679

[45] Date of Patent: Apr. 27, 1999

[54] ARTICLE OF FOOTWEAR

[76] Inventor: Phillip Baldwin, 3703 Bedford La., Memphis, Tenn. 38118

[21] Appl. No.: 09/097,568

[22] Filed: Jun. 15, 1998

Related U.S. Application Data

[63] Continuation of application No. 29/059,640, Aug. 26, 1996, abandoned.

[51] Int. Cl.[6] ..... A43B 13/28; A43B 21/32

[52] U.S. Cl. ..... 36/27; 36/35 R; 36/37; 36/38

[58] Field of Search ..... 36/37, 7.8, 35 R, 36/27, 38

[56] References Cited

U.S. PATENT DOCUMENTS

| | | | |
|---|---|---|---|
| D. 194,346 | 1/1963 | Levine | D7/7 |
| D. 353,705 | 12/1994 | Hatfield | D2/897 |
| D. 377,240 | 1/1997 | La Magna | D28/60 |
| 418,922 | 1/1890 | Minahan | 36/37 |
| 1,625,048 | 4/1927 | Nock | 36/38 |
| 2,383,877 | 8/1945 | Miller | 36/37 |
| 3,886,674 | 6/1975 | Pavia | 36/38 |
| 4,457,084 | 7/1984 | Horibata et al. | 3/10 |
| 4,592,153 | 6/1986 | Jacinto | 36/38 |
| 4,689,898 | 9/1987 | Fahey | 36/88 |
| 4,756,095 | 7/1988 | Lakic | 7/2 |
| 5,203,095 | 4/1993 | Allen | 21/30 |
| 5,343,637 | 9/1994 | Schindler | 13/18 |
| 5,437,110 | 8/1995 | Goldston et al. | 21/30 |

FOREIGN PATENT DOCUMENTS

| | | | |
|---|---|---|---|
| 1169-599 | 7/1995 | U.S.S.R. | 36/27 |

*Primary Examiner*—M. D. Patterson

*Attorney, Agent, or Firm*—Walker, McKenzie & Walker, P.C.

[57] ABSTRACT

An article of footwear for being worn on a wearer's foot as the wearer steps on a support surface. The article of footwear comprises a sole member having an upper surface for supporting the sole of the wearer's foot, a lower surface, a heel end, and a toe end; and a heel mechanism attached to the heel end of the sole member; the heel mechanism including a first plate for attachment to the lower surface of the sole member adjacent the heel end thereof, the first plate having a first end and a second end; the heel mechanism including a second plate having a first end attached to the first end of the first plate and a second end normally urged away from the second end of the first plate; the heel mechanism including lever structure associated with the second plate for urging the second end of the second plate toward the second end of the first plate when the wearer of the article of footwear takes a step.

7 Claims, 2 Drawing Sheets

11
39
33
35
3
19
41
31
S
37
F
69
23
3
57
55
45
61
59
47
53
43
63
64
29
15
17
13
27
25
21

11
37
F
69
23
39
33
35
19
31
S
41
57
55
45
61
59
47
53
43
63
64
29
13
15
17
27
21
25

FIG. 3
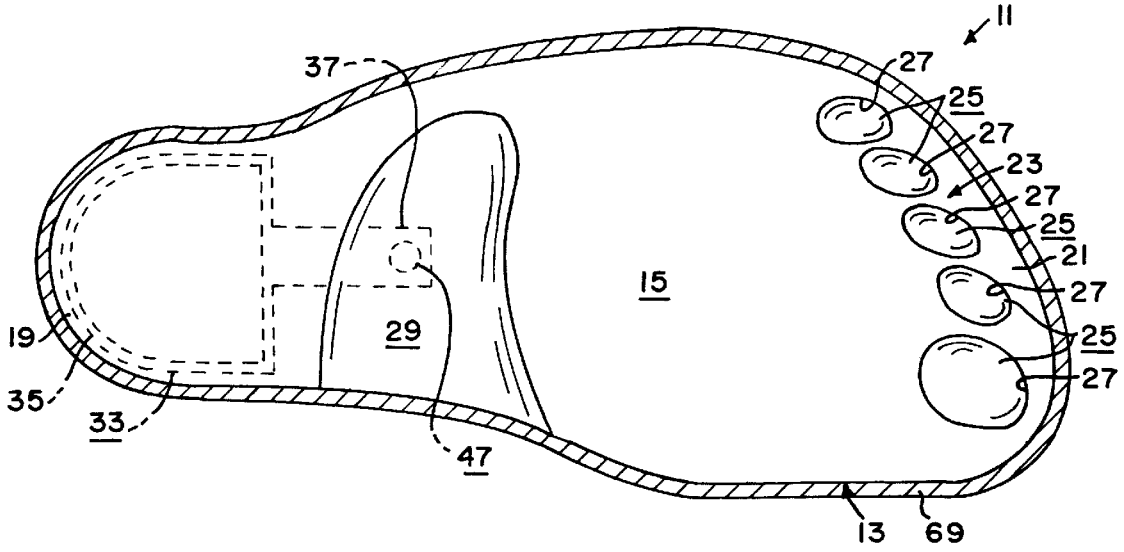
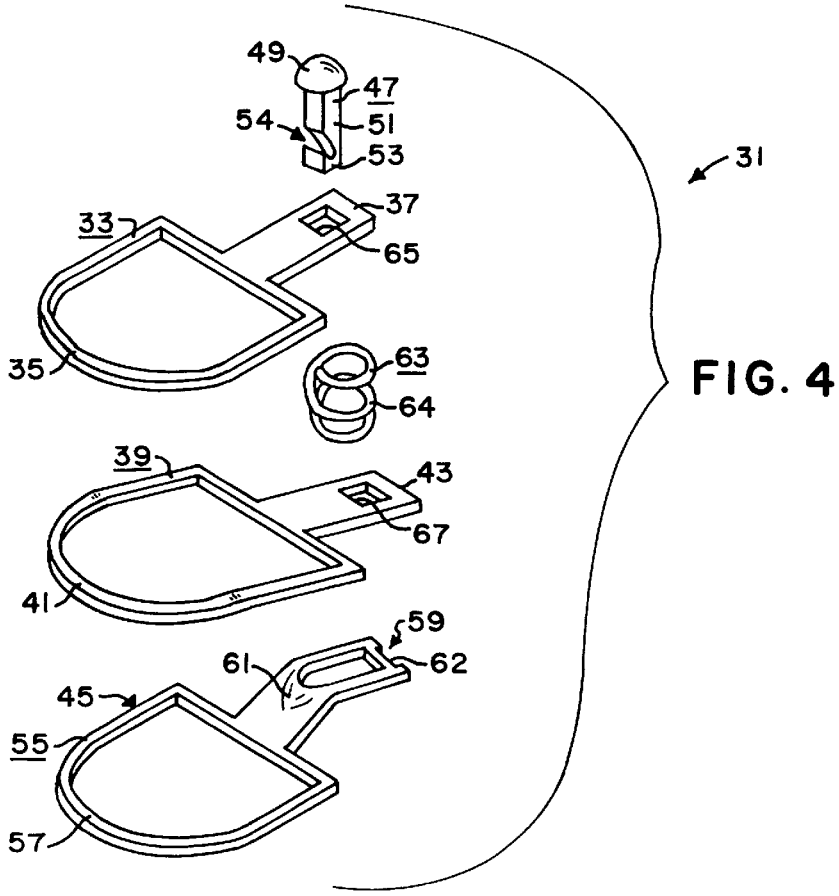
FIG. 4

ARTICLE OF FOOTWEAR

CROSS-REFERENCE TO RELATED APPLICATIONS

This is a continuation of application Ser. No. 29/059,640, entitled "SHOE SHOCKS," filed Aug. 26, 1996, now abandoned.

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to an improved article of footwear and, more specifically, to a shoe or similar article having an improved heel mechanism for absorbing the shock or impact of the wearer of the article of footwear as the wearer takes a step.

2. Information Disclosure Statement

The inventor is aware of the following patents which appear to be relevant to the present invention: La Magna, U.S. Pat. No. D 377,240, issued Jan. 7, 1997; Horibata et al., U.S. Pat. No. 4,457,084, issued Jul. 3, 1984; Lakic, U.S. Pat. No. 4,756,095, issued Jul. 12, 1988; Allen, U.S. Pat. No. 5,203,095, issued Apr. 20, 1993; Schindler, U.S. Pat. No. 5,343,637, issued Sep. 6, 1994; Goldston et al., U.S. Pat. No. 5,437,110, issued Aug. 1, 1995; Levine, U.S. Pat. No. D 194,346, issued Jan. 8, 1963; Hatfield, U.S. Pat. No. D 353,705, issued Dec. 27, 1994; and Pyatnitskii, Soviet Patent 1169-599-A, dated Jul. 30, 1985.

Nothing in the known prior art discloses or suggests the present invention. More specifically, nothing in the known prior art discloses or suggests an article of footwear comprising, in general, a sole member having an upper surface for supporting the sole of a wearer's foot, a lower surface, a heel end, and a toe end; and a heel mechanism attached to the heel end of the sole member; the heel mechanism including a first plate for attachment to the lower surface of the sole member adjacent the heel end thereof, the first plate having a first end and a second end; the heel mechanism including a second plate having a first end attached to the first end of the first plate and a second end normally urged away from the second end of the first plate; the heel mechanism including lever means associated with the second plate for urging the second end of the second plate toward the second end of the first plate when the wearer of the article of footwear takes a step.

BRIEF SUMMARY OF THE INVENTION

The present invention provides an article of footwear such as an improved work boot, walking shoe, cross-training shoe, tennis shoe, etc. A basic concept of the present invention is to provide such an article of footwear which reduces the shock to the wearer's heel, calf, shin, ankles, etc.

The article of footwear of the present invention comprises, in general, a sole member having an upper surface for supporting the sole of a wearer's foot, a lower surface, a heel end, and a toe end; and a heel mechanism attached to the heel end of the sole member; the heel mechanism including a first plate for attachment to the lower surface of the sole member adjacent the heel end thereof, the first plate having a first end and a second end; the heel mechanism including a second plate having a first end attached to the first end of the first plate and a second end normally urged away from the second end of the first plate; the heel mechanism including lever means associated with the second plate for urging the second end of the second plate toward the second end of the first plate when the wearer of the article of footwear takes a step.

One object of the present invention is to provide an article of footwear which reduces the shock to the wearer's heel, calf, shin, ankles, etc.

Another object of the present invention is to provide an article of footwear that transfers the force of stepping from the wearer's heel to the wearer's arch, more aligned with the long axis of the wearer's tibia, etc.

Another object of the present invention is to provide an article of footwear in which the sole member thereof includes grip means adjacent to the toe end thereof for gripping the wearer's foot to help keep the wearer's foot from slipping in the article of footwear.

Another object of the present invention is to provide an article of footwear which is adjustable for wearer's of different weights, etc.

BRIEF DESCRIPTION OF TBE SEVERAL VIEWS OF THE DRAWINGS

FIG. 3 is a sectional view substantially as taken on line 3—3 of FIG. 1.

FIG. 4 is an exploded perspective view of the heel mechanism of the article of footwear of the present invention.

DETAILED DESCRIPTION OF THE INVENTION

Figure 1:
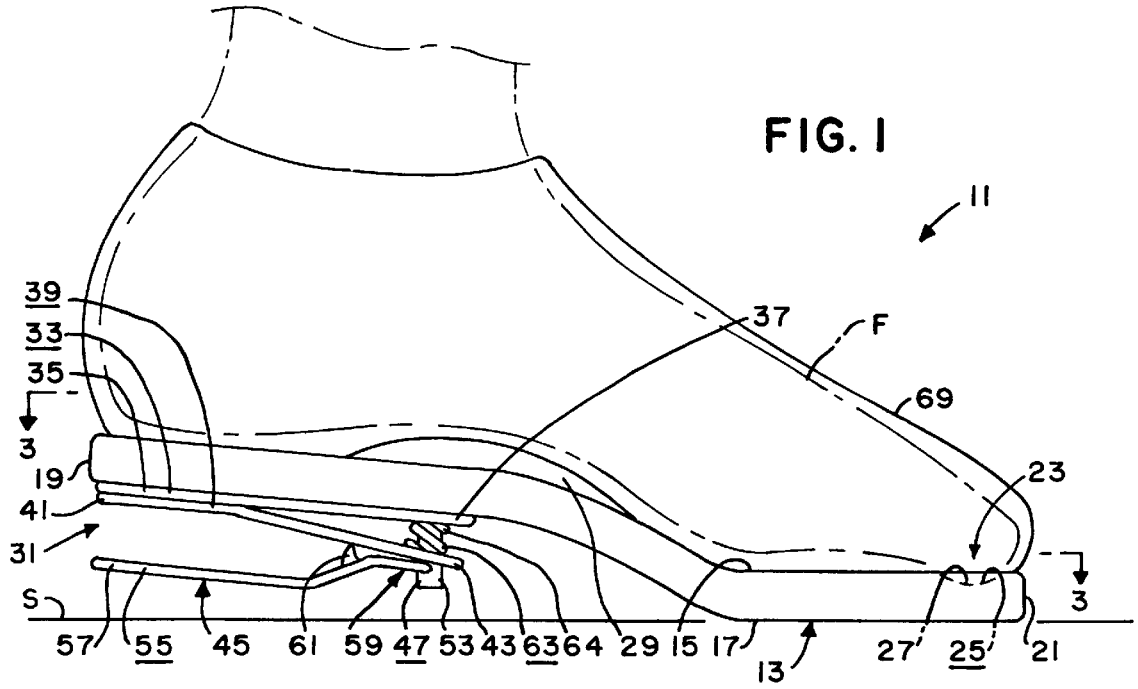
FIG. 1 is a side elevational view of the article of footwear of the present invention, shown in combination with a wearer's foot and with no weight applied to the wearer's heel.
Figure 2:
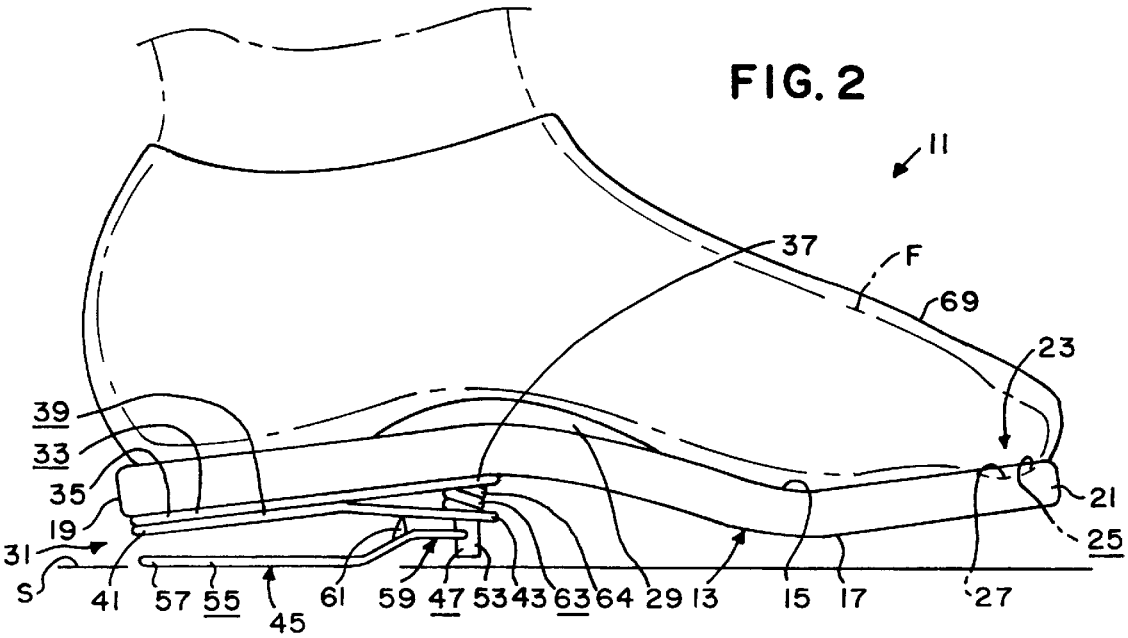
FIG. 2 is a side elevational view of the article of footwear similar to FIG. 1, but showing weight applied to the wearer's heel.

A preferred embodiment of the article of footwear of the present invention is shown in FIGS. 1–4, and identified by the numeral 11. The article of footwear 11 is for being worn on a wearer's foot F as the wearer steps on a support surface S (see FIGS. 1 and 2).

The article of footwear 11 includes a sole member 13 having an upper surface 15 for supporting the sole of the wearer's foot F, a lower surface 17, a heel end 19, and a toe end 21.7. The upper surface 15 of the sole member 13 preferably includes grip means 23 adjacent the toe end 21 of the sole member 13 for gripping the wearer's foot F. The grip means 23 preferably includes toe grip means 25 for gripping the toes of the wearer's foot F. The toe grip means 25 preferably includes concavities or depressions 27 in the upper surface 15 of the sole member 13 adjacent the toe end 21 of the sole member 13 for receiving lower portions of the toes of the wearer's foot F as clearly shown in FIGS. 1–3. The sole member 13 preferably has an arch support 29 on the upper surface 15 intermediate the heel and toe ends 19, 21 for supporting the arch of the wearer's foot F.

The article of footwear 11 includes a heel mechanism 31 attached to the heel end 19 of the sole member 13. The heel mechanism 31 includes a first plate 33 for attachment to the lower surface 17 of the sole member 13 adjacent the heel end 19 thereof. The first plate 33 has a first end 35 and a second end 37. The heel mechanism 31 includes a second plate 39 having a first end 41 attached to the first end 35 of the first plate 33 and a second end 43 normally urged away from the second end 37 of the first plate 33. The heel mechanism 31 includes lever means 45 associated with the second plate 39 for urging the second end 43 of the second plate 39 toward the second end 37 of the first plate 33 when the wearer of the article of footwear 11 takes a step.

The heel mechanism 31 preferably includes a bolt member 47 having a first end 49 attached to the first plate 33 adjacent the second end 37 thereof, having a midportion 51 extending through the second plate 39 adjacent the second end 43 thereof, and having a second end 53. The second end 53 of the bolt member 47 may have a side slot 54 thereacross for reasons which will hereinafter become apparent. The side slot 54 preferably extends inwardly and downwardly toward the distal end of the second end 53 of the bolt member 47.

The lever means 45 preferably includes an elongated lever 55 having a first end 57 for contacting the support surface S when the wearer of the article of footwear 11 takes a step, having a second end 59 pivotally attached to the second end 53 of the bolt member 47, and having a cam portion 61 located between the first and second ends 57, 59 thereof for engaging the second plate 39 between the first and second ends 41, 43 thereof and for urging the second end 43 of the second plate 39 toward the second end 37 of the first plate 33 when the wearer of the article of footwear 11 takes a step. The second end 59 of the lever 55 preferably includes a pivot bar 62 for extending into the side slot 54 in the second end 53 of the bolt member 47 to thereby pivotally attach the lever 55 to the bolt member 47.

The heel mechanism 31 preferably includes spring means 63 for normally urging the second end 43 of the second plate 39 away from the second end 37 of the first plate 33. The spring means 63 preferably includes a coil spring 64 positioned about the bolt member 47 between the first and second plates 33, 39. That is, the coil spring 64 is preferably of a size that allows the midportion 51 and second end 53 of the bolt member 47 to extend through the hollow center thereof as will now be apparent to those skilled in the art. The second end 37 of the first plate 33 has an aperture 65 therethrough, large enough to allow the midportion 51 and second end 53 of the bolt member 47 to extend therethrough, but too small to allow the first end 49 of the bolt member 47 from passing therethrough. The second end 43 of the second plate 39 preferably has an aperture 67 therethrough, large enough to allow the midportion 51 and second end 53 of the bolt member 47 to extend therethrough, but too small to allow the coil spring 64 of the spring means 63 to pass therethrough. The cross-sectional shape of the shaft of the bolt member 47 (i.e., the midportion 51 and second end 53 thereof), and the apertures 65, 67 are preferably non-circular (e.g., square) to prevent rotation of the bolt member 47 relative to the first and second plates 33, 39.

The strength of the spring means, i.e., the amount of force or pressure applied by the spring means 63 to urge the second end 43 of the second plate 39 away from the second end 37 of the first plate 33, is preferably adjustable. For example, the spring means 63 could merely include a plurality of coil springs of different strengths to allow the user of the article of footwear 11 to effectively vary the strength of the spring means 63 by choosing which coil spring to insert between the first and second plates 33, 39. On the other hand, the bolt member 47 may be constructed as a generally typical bolt with the first end 49 forming an enlarged head and with the midportion 51 and second end 53 forming a threaded shaft, and the aperture 67 may be threaded for threadably coacting with the threaded midportion 51 and second end 53 of the bolt member 47 so that rotation of the bolt member 47 will cause the second ends 37, 43 of the first and second plates 33, 39, respectively, to be forced toward or away from one another, thereby allowing the coil spring 64 to be pre-compressed, to vary its effective strength.

The distal end of the second end 53 of the bolt member 47 may have a transverse slot or the like (not shown) for allowing a typical tool such as a screwdriver to be used to rotate the bolt member 47. On the other and, rather than threading the aperture 67, a typical threaded nut, not shown, could be threaded onto the second end 53 of the bolt member 47 beneath the second plate 39, etc.

The first plate 33 is preferably sized and mounted on the sole member 13 so that the second end 37 thereof can be positioned directly beneath the arch support 29 of the sole member 13.

The actual construction and ornamental design of the article of footwear 11 may vary as will now be apparent to those skilled in the art. The sole member 13 may be constructed in any typical manner out of leather, rubber, or a composite material, etc., with the depressions 27 molded, cut, machined, or otherwise formed in the upper surface 15 thereof, and with the arch support 29 molded, glued, or otherwise formed on the upper surface 15 thereof. The plate members 33, 39, lever means 45, and bolt means 55 may be machined, cast, stamped, or otherwise formed out of a strong metal such as stainless steel or the like. The first ends 35, 41, 57 of the first plate 33, second plate 39, and lever 55, respectively, are preferably open as clearly shown in FIG. 4 to reduce the over-all weight of the article of footwear 11, etc. A flexible cover (not shown) may cover the heel mechanism 31 and be attached to the heel end 19 of the sole member 13 to protect the heel mechanism 31, etc., and give the article of footwear 11 the appearance of typical footwear. Any specific style of footwear upper 69 can be attached to the sole member 13 to give the article of footwear 11 there appearance and function of a dress shoe, walking shoe, cross-trainer, tennis shoe, work boot, sandal, etc.

As thus constructed and used, the present invention provides an article of footwear having an improved heel mechanism that absorbs the shock or impact of the wearer of the article of footwear as the wearer takes a step; that transfers the force of stepping from the wearer's heel to the wearer's arch, more aligned with the long axis of the wearer's tibia, etc.; and having a sole member including grip means adjacent the toe end thereof for gripping the wearer's foot to help keep the wearer's foot from slipping in the article of footwear; etc.

Although the present invention has been described and illustrated with respect to a preferred embodiments and a preferred uses therefor, it is not to be so limited since modifications and changes can be made therein which are within the full intended scope of the invention.

I claim:

1. An article of footwear for being worn on a wearer's foot as the wearer steps on a support surface; the article of footwear comprising:

(a) a sole member having an upper surface for supporting the sole of the wearer's foot, a lower surface, a heel end, and a toe end; and (b) a heel mechanism attached to the heel end of the sole member; the heel mechanism including a first plate for attachment to the lower surface of the sole member adjacent the heel end thereof, the first plate having a first end and a second end; the heel mechanism including a second plate having a first end attached to the first end of the first plate and a second end normally urged away from the second end of the first plate; the heel mechanism including lever means for engaging the second plate and for urging the second end of the second plate toward the second end of the first plate when the wearer of the article of footwear takes a step;

the heel mechanism including a bolt member having a first end attached to the first plate adjacent the second end thereof, having a midportion extending through the second plate adjacent the second end thereof, and having a second end; and the lever means including an elongated lever having a first end for contacting the support surface when the wearer of the article of footwear takes a step, having a second end pivotally attached to the second end of the bolt member, and having a cam portion located between the first and second ends of the lever for engaging the second plate between the first and second ends of the second plate and for urging the second end of the second plate toward the second end of the first plate when the wearer of the article of footwear takes a step.

2. The article of footwear of claim 1 in which the heel mechanism includes spring means for normally urging the second end of the second plate away from the second end of the first plate.

3. The article of footwear of claim 2 in which the spring means includes a coil spring positioned about the bolt member between the first and second plates.

4. The article of footwear of claim 2 in which the strength of the spring means is adjustable.

5. The article of footwear of claim 1 in which the upper surface of the sole member includes grip means adjacent the toe end of the sole member for gripping the wearer's foot.

6. The article of footwear of claim 5 in which the grip means include toe grip means for gripping the toes of the wearer's foot.

7. The article of footwear of claim 1 in which the sole member has an arch support on the upper surface thereof intermediate the heel and toe ends thereof for supporting the arch of the wearer's foot; and in which the second end of the first plate of the heel mechanism is positioned directly beneath the arch support of the sole member.

* * * * *